US009481495B2

(12) United States Patent
Bellmore et al.

(10) Patent No.: US 9,481,495 B2
(45) Date of Patent: Nov. 1, 2016

(54) DISPENSING SYSTEM

(71) Applicant: Scholle Corporation, Irvine, CA (US)

(72) Inventors: David Bellmore, DeWitt, MI (US); Kyle Erickson, Chicago, IL (US)

(73) Assignee: Scholle IPN Corporation, Northlake, IL (US)

( * ) Notice: Subject to any disclaimer, the term of this patent is extended or adjusted under 35 U.S.C. 154(b) by 0 days.

(21) Appl. No.: 14/261,366

(22) Filed: Apr. 24, 2014

(65) Prior Publication Data

US 2015/0307236 A1 Oct. 29, 2015

(51) Int. Cl.

| | |
|---|---|
| ***B65D 35/38*** | (2006.01) |
| ***B65D 35/30*** | (2006.01) |
| ***B65D 75/58*** | (2006.01) |
| ***B65D 83/00*** | (2006.01) |

(52) U.S. Cl.

CPC ..... *B65D 35/30* (2013.01); *B65D 35/38* (2013.01); *B65D 75/5883* (2013.01); *B65D 83/0072* (2013.01)

(58) Field of Classification Search

CPC ..... B65D 35/30; B65D 35/38
USPC ..... 222/95, 490, 491, 105, 494, 107, 541.1, 222/541.9, 566; 383/44, 51, 42
See application file for complete search history.

(56) References Cited

U.S. PATENT DOCUMENTS

| | | | | | |
|---|---|---|---|---|---|
| 2,100,025 | A | * | 11/1937 | Douglas | 439/509 |
| 2,634,692 | A | | 4/1953 | Sherbondy | |
| 3,135,441 | A | * | 6/1964 | Wise et al. | 222/541.9 |
| 3,160,327 | A | * | 12/1964 | Porcelli | 222/153.07 |
| 3,161,325 | A | * | 12/1964 | Hinkel et al. | 222/80 |
| 3,690,524 | A | * | 9/1972 | Haberhauer | 222/573 |
| 3,933,273 | A | * | 1/1976 | Cox | 222/1 |
| 4,090,541 | A | * | 5/1978 | Cammarata et al. | 604/408 |
| 4,163,509 | A | * | 8/1979 | Amneus | 222/95 |
| 4,323,176 | A | * | 4/1982 | Sartain | 222/326 |
| 4,339,058 | A | * | 7/1982 | Wendt | 222/309 |
| 4,394,936 | A | * | 7/1983 | Shavit | 222/107 |
| 4,938,390 | A | * | 7/1990 | Markva | 222/541.4 |
| 4,966,537 | A | * | 10/1990 | Bowles et al. | 425/87 |
| 4,969,581 | A | * | 11/1990 | Seifert et al. | 222/212 |
| 4,987,740 | A | * | 1/1991 | Coleman | 60/583 |
| 5,071,017 | A | * | 12/1991 | Stull | 215/260 |
| 5,307,955 | A | * | 5/1994 | Viegas | 222/107 |
| 5,323,931 | A | * | 6/1994 | Robards et al. | 222/96 |
| 5,370,271 | A | * | 12/1994 | Segatz | 222/95 |
| 5,377,877 | A | * | 1/1995 | Brown et al. | 222/105 |

(Continued)

FOREIGN PATENT DOCUMENTS

| | | | |
|---|---|---|---|
| JP | 2000-159258 | A | 6/2000 |
| JP | 2004-059071 | A | 2/2004 |

*Primary Examiner* — Kevin P Shaver
*Assistant Examiner* — Michael J Melaragno
(74) *Attorney, Agent, or Firm* — The Watson IP Group, PLC; Jovan N. Jovanovic; Vladao M. Yasiljevic

(57) ABSTRACT

A dispensing system which has a dispenser housing assembly, and a bag assembly that fits within the dispensing housing assembly. The bag assembly includes a flexible bag and an integrated spout and valve member. The integrated spout and valve member includes a spout portion which has an annular base flange and a spout body extending therefrom. A valve is positioned within the spout body. The valve including an opening that can be selectively opened to allow the passage of a flowable material from within the flexible bag.

13 Claims, 8 Drawing Sheets

(56) References Cited

U.S. PATENT DOCUMENTS 5,409,144 A * 4/1995 Brown ..... 222/185.1
5,411,178 A * 5/1995 Roders et al. ..... 222/105
5,511,697 A * 4/1996 Gruenbacher et al. ..... 222/107
5,839,614 A * 11/1998 Brown ..... 222/185.1
5,971,613 A * 10/1999 Bell ..... 383/107
6,000,848 A * 12/1999 Massioui ..... 383/80
6,003,730 A * 12/1999 David et al. ..... 222/107
6,050,451 A * 4/2000 Hess et al. ..... 222/92
6,065,642 A * 5/2000 Brown ..... 222/92
6,079,594 A * 6/2000 Brown et al. ..... 222/107
6,153,238 A * 11/2000 Shannon ..... 426/115
6,273,305 B1 * 8/2001 Fioravanti et al. ..... 222/494
6,273,307 B1 * 8/2001 Gross et al. ..... 222/566
H002027 H * 6/2002 Brown et al. ..... 215/260
6,530,504 B2 * 3/2003 Socier ..... 222/494
6,607,097 B2 * 8/2003 Savage ..... B65D 75/5877 220/62.12
6,666,353 B1 * 12/2003 Olivier ..... 222/105
6,685,691 B1 * 2/2004 Freund et al. ..... 604/403
6,860,406 B2 * 3/2005 Kobetsky et al. ..... 222/92
6,991,121 B1 * 1/2006 Kipperman et al. ..... 215/11.1
7,163,130 B2 * 1/2007 Lafond ..... 222/326
7,232,042 B2 * 6/2007 Last ..... 222/1
D563,220 S * 3/2008 Krivoshein ..... D9/454
7,350,669 B2 * 4/2008 Rani ..... 222/92
7,597,244 B2 * 10/2009 Boldrini et al. ..... 229/125.14
7,618,405 B2 * 11/2009 Young ..... 604/403
7,762,430 B2 * 7/2010 Wild et al. ..... 222/107
7,828,198 B2 * 11/2010 Boldrini et al. ..... 229/125.015
7,850,044 B2 * 12/2010 Hildebrand et al. ..... 222/107
8,397,958 B2 * 3/2013 Smith et al. ..... 222/494
8,511,520 B2 * 8/2013 Van Wijk et al. ..... 222/391
8,608,034 B2 * 12/2013 Bloom ..... 222/490
D698,616 S * 2/2014 Van Wijk et al. ..... D7/672
8,820,578 B2 * 9/2014 Kneer et al. ..... 222/95
2001/0042762 A1 * 11/2001 Reichert ..... 222/326
2005/0006413 A1 * 1/2005 Miyata et al. ..... 222/327
2007/0084887 A1 * 4/2007 Schelbach ..... 222/566
2008/0199108 A1 * 8/2008 Rogers ..... 383/38
2009/0120959 A1 5/2009 So et al.
2009/0127287 A1 * 5/2009 Faller ..... 222/107
2009/0129706 A1 * 5/2009 Otsuka et al. ..... 383/42
2009/0188950 A1 * 7/2009 Gaus ..... B65D 47/2031 222/494
2009/0212078 A1 * 8/2009 Gaus ..... 222/490
2010/0021089 A1 * 1/2010 Arvizu ..... 383/42
2010/0127006 A1 * 5/2010 Krammes ..... A47G 19/2272 220/705
2010/0150478 A1 * 6/2010 Murray ..... 383/42
2010/0230438 A1 * 9/2010 Sardo, Jr. ..... 222/105
2011/0006076 A1 * 1/2011 Williams ..... 222/95
2011/0007987 A1 * 1/2011 Davideit et al. ..... 383/42
2011/0017772 A1 * 1/2011 Jacoulet et al. ..... 222/1
2011/0062192 A1 * 3/2011 Gruber ..... 222/566
2011/0121028 A1 * 5/2011 Rusch ..... 222/96
2011/0132941 A1 * 6/2011 Kim ..... 222/566
2012/0187158 A1 * 7/2012 Pritchard ..... B65D 47/103 222/501
2013/0098784 A1 * 4/2013 Spendlow et al. ..... 206/222
2013/0233886 A1 * 9/2013 Long et al. ..... 222/95
2013/0327790 A1 * 12/2013 Ryan ..... 222/95
2013/0341352 A1 * 12/2013 Williams ..... 222/95
2014/0110433 A1 * 4/2014 Schick ..... 222/107
2014/0138406 A1 * 5/2014 Sanfilippo et al. ..... 222/95
2014/0231452 A1 * 8/2014 James et al. ..... 222/105
2014/0263474 A1 * 9/2014 Skillin et al. ..... 222/541.9
2014/0319094 A1 * 10/2014 Thurman et al. ..... 215/253
2015/0014369 A1 * 1/2015 Hatton et al. ..... 222/490
2015/0053717 A1 * 2/2015 Williams et al. ..... 222/95
2015/0114986 A1 * 4/2015 Ngu et al. ..... 222/1

* cited by examiner

DISPENSING SYSTEM

CROSS-REFERENCE TO RELATED APPLICATION

NA

BACKGROUND OF THE DISCLOSURE

1. Field of the Disclosure

The invention relates in general to a dispensing system, and more particularly, to a metered dispensing system which utilizes an integrated spout and valve coupled to a bag within a metering dispenser.

2. Background Art

The metered dispensing of different flowable materials in a repeatable and controllable manner is known in the art. For example, in the fast food industry, a preparer must often quickly and efficiently dispense a generally known quantity of a flowable material onto foodstuffs, such as, for example, sandwiches, tacos or salads, among others. While the dispensing of an improper amount may be of little consequence, even a slight over dispensing of a condiment can negatively affect the desired flavor. In addition, even a slight over dispensing over the millions and millions of cycles of the dispenser can add up to be quite costly.

In turn, various solutions have been developed to provide a metered dispensing of such flowable material in a controlled, and efficient manner. Many of such solutions require the pressing of a trigger which dispenses a predetermined quantity of the flowable material from within a holding chamber. The trigger can be repeatedly actuated to deliver the same quantity of flowable material until the dispenser has been emptied.

Problematically, such containers, while effectively delivering a desired dose of flowable material, nevertheless suffer drawbacks. For example, many of such devices include a plurality of components that are assembled to form the dispenser. Many of these components come into contact with the flowable material. This includes the housing, the seals, some of the actuator components and the valve. As such, from time to time, the dispenser is typically fully disassembled and thoroughly cleaned. Not only is such a process time consuming, but in many instances there can be problems or issues that arise from the disassembly and reassembly processes.

SUMMARY OF THE DISCLOSURE

The disclosure is directed to, in one aspect thereof, a dispensing system comprising a dispenser housing assembly and a bag assembly. The dispenser housing assembly having a canister, a dispensing mechanism, and a lower cap. The canister has a first end and a second end. The dispensing mechanism is coupled to the canister at the first end thereof. The dispensing mechanism has a piston slidably movable along the canister between the first end and the second end thereof. The lower cap is coupled to the canister at the second end thereof. The lower cap includes a central body with a central opening extending therethrough.

The bag assembly has a flexible bag, and an integrated spout and valve member. The flexible bag is defined by a plurality of seals that form the sides and second end. The first end is defined by a fold. The flexible bag defines a fluid tight cavity with an opening at the fold for providing ingress into the fluid tight cavity. The integrated spout and valve member is molded as a single member and coupled to the flexible bag at the first end and extending over the fold. The integrated spout and valve member is placed in fluid communication with the fluid tight cavity by way of the opening. The integrated spout and valve member further includes a spout portion and a valve portion. The spout portion includes a spout body with a proximal end and a distal end. An annular base flange is coupled to the spout body at the proximal end. The valve portion is disposed within the spout body. The valve portion includes a central portion with an opening, an annular marginal portion extending therearound, an annular sidewall portion extending from the annular marginal portion toward the distal end of the spout body, and an annular outwardly extending portion extending outwardly from the annular sidewall portion and coupled to an inner surface of the spout body. The valve portion spans across the spout body, with the opening providing passage therethrough.

In a preferred embodiment, the valve portion is maintained between the proximal end and the distal end of the spout body.

In another preferred embodiment, the spout body has a first thickness between the proximal end and the annular outwardly extending portion and a second thickness between the distal end and the annular outwardly extending portion. The first thickness is greater than the second thickness.

In another preferred embodiment, the annular outwardly extending portion is substantially perpendicular to the inner surface of the spout body.

In another preferred embodiment, the flexible bag comprises a single monolithic member having a first side seal extending from the fold on one side of the spout portion and a second side seal extending from the fold on another side of the spout portion. The first side seal and the second side seal each include an outer portion extending obliquely away from the fold and a side portion substantially perpendicular to the fold and oblique to the outer portion.

In another preferred embodiment, the end seal includes a central region that is substantially parallel to the fold and spaced apart therefrom. A first side region and a second side region is either side thereof and is coupled to a respective one of the first and second side seals. The first and second side regions being oblique to each of the side portions.

In another preferred embodiment, the annular base flange has an outer surface which is sealed to an inner surface of the flexible bag such that a portion of the annular base flange is positioned within the fluid tight cavity of the flexible bag.

In another preferred embodiment, the annular base flange comprises a conical configuration extending outwardly from the proximal end of the spout body in a concave upward configuration.

In another preferred embodiment, the central body of the lower cap further includes an inner conical portion disposed about the central opening. The inner conical portion substantially corresponding to the conical configuration of the annular base flange.

In another preferred embodiment, the central opening further comprises a slot region configured to allow the distal end of the spout to pass therethrough. The slot region is in communication with the operating region.

In another preferred embodiment, the canister and the lower cap are coupled together through rotative engagement of less than a half turn of the lower cap relative to the canister. And preferably less than an quarter turn.

In another preferred embodiment, the integrated spout and valve member further includes an outer flange positioned at the distal end of the spout body.

In yet another preferred embodiment, the outer flange further includes an inner surface and an outer surface. The outer flange has a diameter smaller than that of the annular base flange.

In another preferred embodiment, the outer flange is substantially perpendicular to the spout body.

Preferably, an outer lip portion is disposed on the outer surface of the outer flange, to, in turn, define a cavity together with the outer surface.

In some such embodiments, a removable cover is positioned within the cavity so as to extend across the distal end of the spout body and to cover the valve portion.

In another preferred embodiment, the flexible bag further comprises a pull tab positioned proximate the second end of the flexible bag. The pull tab is structurally configured to facilitate the grasping of the flexible bag to aid in pulling the flexible bag into and through the canister and into a desired orientation.

In another preferred embodiment, the pull tab is integrally formed with the flexible bag.

In another aspect of the disclosure, the disclosure is directed to an integrated spout and valve member molded as a single member attachable to a flexible bag. The integrated member comprises a spout portion and a valve portion. The spout portion includes a spout body with a proximal end and a distal end. An annular base flange is coupled to the spout body at the proximal end. The valve portion is disposed within the spout body. The valve portion includes a central portion with an opening, an annular marginal portion extending therearound, an annular sidewall portion extending from the annular marginal portion toward the distal end of the spout body, and an annular outwardly extending portion extending outwardly from the annular sidewall portion and coupled to an inner surface of the spout body. The valve portion spans across the spout body, with the opening providing passage therethrough.

In a preferred embodiment, the annular base flange comprises a conical configuration extending outwardly from the proximal end of the spout body in a concave upward configuration.

In another preferred embodiment, the integrated spout and valve member further has an outer flange positioned at the distal end of the spout body.

In yet another preferred embodiment, the integrated spout and valve member further has a removable cover positioned over the outer flange so as to cover the valve portion within the spout body.

BRIEF DESCRIPTION OF THE DRAWINGS

The disclosure will now be described with reference to the drawings wherein.

DETAILED DESCRIPTION OF THE DISCLOSURE

Figure 1:
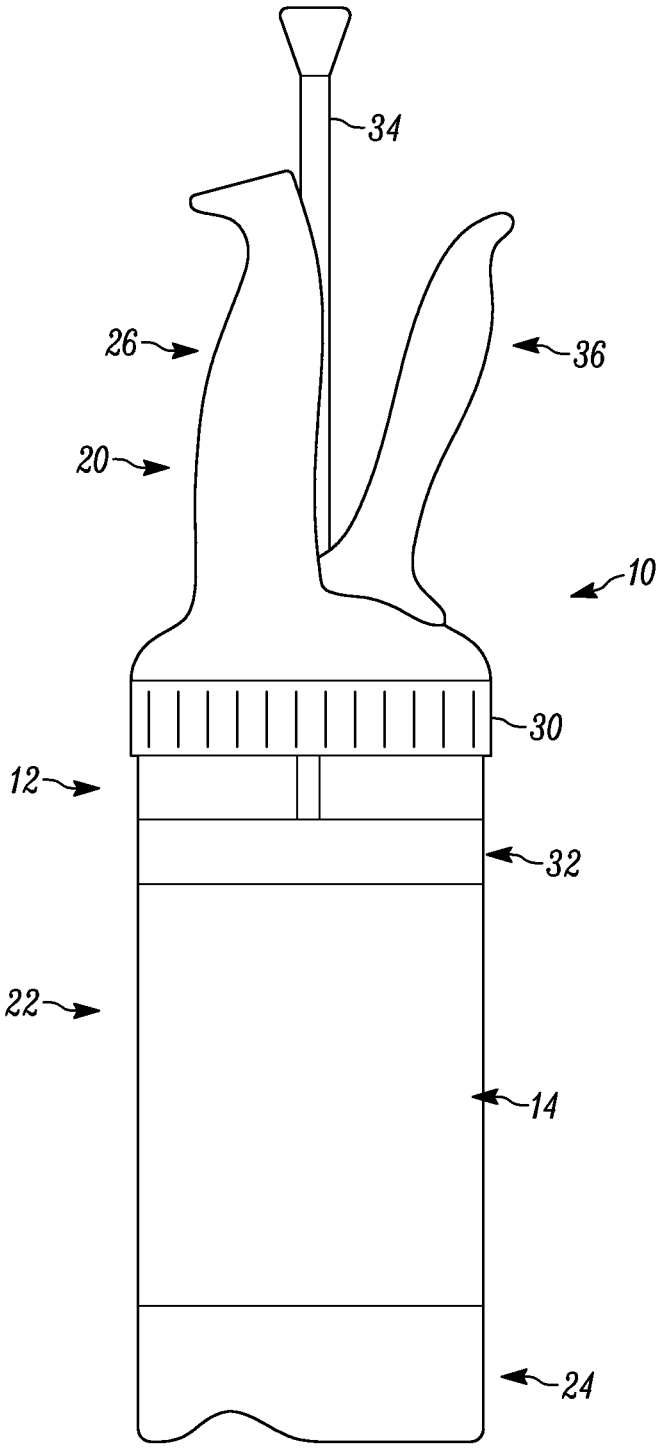
FIG. 1 of the drawings is a side elevational view of the dispensing system of the present disclosure, showing the same in the fully assembled and ready to dispense configuration.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the dispensing system is shown generally at 10. The dispensing system includes dispenser housing assembly 12 and bag assembly 14. It will be understood that the dispensing system is configured for dispensing a predetermined (or adjustably predetermined) amount of a flowable material therefrom upon actuation. While not limited thereto, the system is particularly well suited for the fast food industry, and the dispensing of foodstuffs (i.e., condiments, oils, vinegars, sauces, etc.) onto prepared food (i.e., sandwiches, breads, salads, soups, ethnic foods). It will be understood that the foregoing is merely exemplary, and the dispensing system is not limited to such uses, nor is the system limited to any particular industry.

The dispenser housing assembly 12 includes dispensing mechanism 20, canister 22 and lower cap 24. The dispenser housing assembly 12 is generally sized so as to be handled by a user with one or both hands. The dispensing mechanism 20 comprises body 26 which is coupled to the canister through mounting mechanism 30, a piston 32, a rod 34 coupled to the body and to the piston, and a rod moving mechanism 36. The mounting mechanism comprises a pair of opposing slots that are configured to accept mating tabs and, upon receipt and rotation of the body relative to the canister, the tabs lock within the slots.

Generally, in the installed orientation, the piston 32 is slidably positioned within the canister. The rod 34 is coupled to the piston 32 and configured to slidably direct the piston within the canister. The rod moving mechanism 36 is coupled to the body and to the rod. The rod moving mechanism acts like a trigger which, upon actuation, triggers a desired incremental movement upon the rod, thereby moving the piston a predetermined distance along the canister. One such dispensing mechanism is shown in U.S. Pat. No. 8,511,520 issued to Van Wijk et al. and currently assigned to FundaMetal Design, Inc., of Burnaby, British Columbia, Canada, the entire specification of which is hereby incorporated by reference in its entirety. Another such dispensing mechanism, which is believed to be a commercial embodiment of the '520 patent, is sold under the name "Portion Pal" available from FIFO Bottle of Burnaby, British Columbia, Canada.

Figure 2:
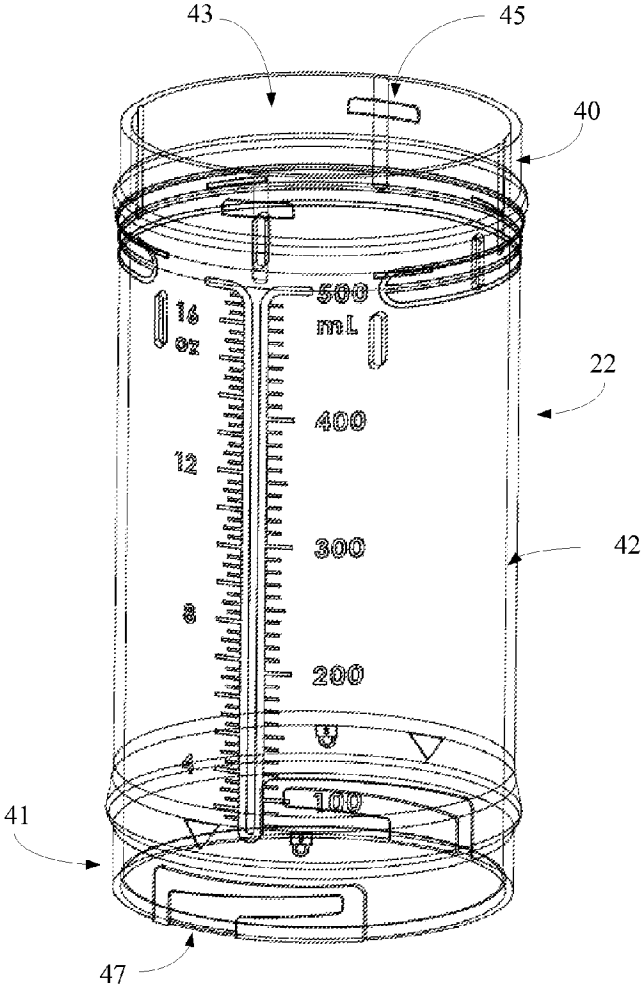
FIG. 2 of the drawings is a perspective view of the canister of the dispensing system of the present disclosure, showing, in particular, the transparent configuration of the same.

As shown in FIG. 2, the canister 22 is shown as comprising an elongated cylindrical member having first end 40, second end 41, outer surface 42 and inner surface 43. Generally, the canister is of a uniform cross-sectional configuration and generally defines a bore and a stroke for the piston. The cross-sectional configuration matches that of the piston, such that the piston can slidably translate between the ends thereof. As such, generally, the inner surface 43 is substantially uniform and smooth so as to promote an efficient slidably translation by the piston. Indicia may be applied to the outer surface (or may be molded into the canister itself), showing, for example, the volume of flowable material that is contained within the canister. In addition, other wording or logos may be disposed on the canister. It is contemplated that the canister is substantially transparent, or at least partially transparent or translucent. In such a configuration, a user can quickly and easily determine the contents and the relative quantity of flowable material that is contained therewithin.

At the first end 40 of the canister 22, a pair of tabs 45 are disposed thereon, which cooperate with the slots identified above with respect to the mounting mechanism 30. It will be understood that once inserted into the slots, a rotation of the two relative to each other locks the two in releasable engagement. At the second end of the canister 22, the lower attachment mechanism is positioned. The lower attachment mechanism comprises a pair of spaced apart slots 47 which are configured to receive opposing tabs, and upon receipt, are configured to releasably engage corresponding tabs in operative engagement. In the embodiment shown, a relative rotation of less than a quarter turn is required to couple the two structures together.

Figure 3:
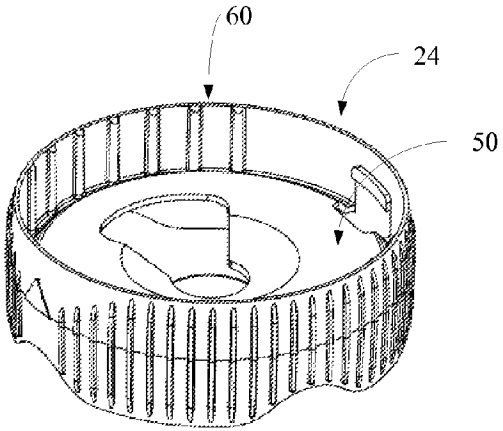
FIG. 3 of the drawings is a perspective view of the lower cap of the dispensing system of the present disclosure.
Figure 5:
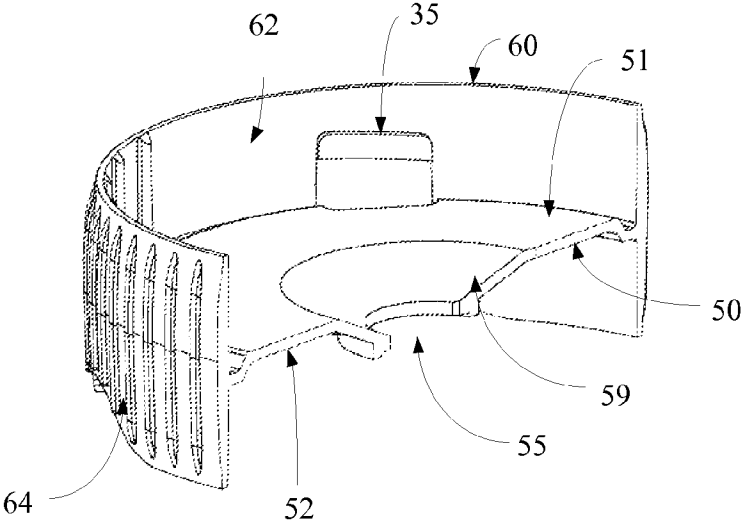
FIG. 5 of the drawings is a perspective cross-sectional view of the lower cap of the dispensing system of the present disclosure.
Figure 4:
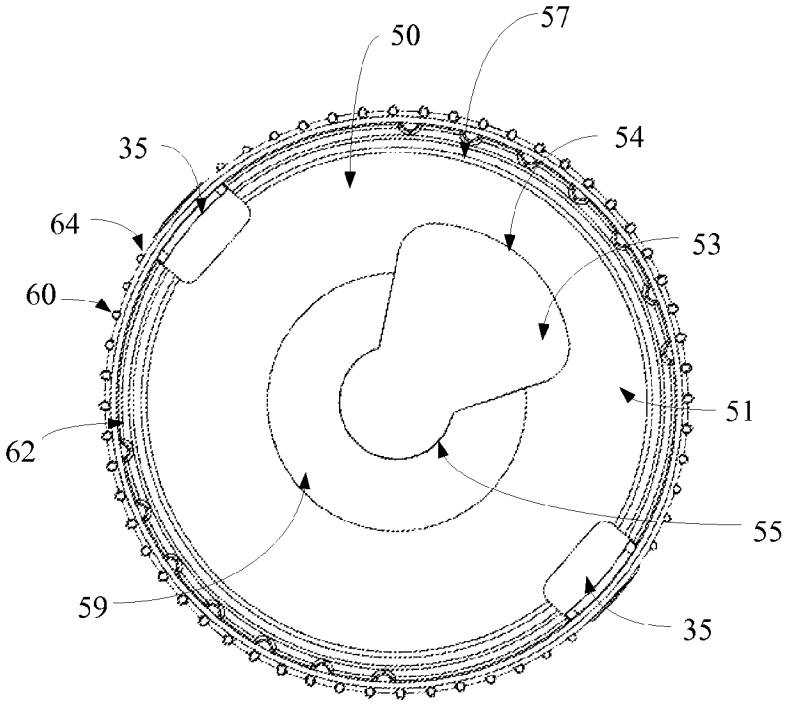
FIG. 4 of the drawings is a top plan view of the lower cap of the dispensing system of the present disclosure.

The lower cap 24 is shown in FIG. 3 as comprising central body 50 and outer annular flange 60. As shown in FIGS. 4 and 5, the central body 50 includes upper surface 51 and lower surface 52. An outer annular valley extends about the outer periphery of the central body. An inner conical portion 59 is presented on the central body centered around the central opening, and in particular the operating region 55 thereof. The inner conical portion provides a funnel toward the central opening, and corresponds to the dimensions of the annular base flange of the spout portion of the spout and valve member.

The central opening 53 includes slot region 54 and operating region 55. The operating region 55 is centrally disposed on the lower cap. The central opening 53 is configured to releasably retain the spout of the integrated spout and valve member 72, in a generally snug manner. To install the spout into the proper orientation, the slot region 54 is provided adjacent to the operating region 55. The slot region comprises an enlarged arcuate region which is configured to allow the spout portion, and in particular the outer flange thereof to extend therethrough so that the spout body between the annular base flange and the outer flange can be positioned into operable engagement with the operating region 55. The overlap is such that the operating region and slot region overlap is generally less than 90° although, ranges up to 150° are contemplated. While it is possible to have the interaction even greater, or lesser, the desire is to have the overlap such that the spout remains within the operating region 55, while the slot region is of sufficient size and the overlap is of sufficient size so as to allow the proper insertion of the spout into operable position.

The outer annular flange 60 is shown in FIG. 5 as comprising inner surface 62 and outer surface 64. The annular flange 60 is positioned such that the central body 50 meets the annular flange 60 spaced apart from either edge such that the flange extends outwardly from both the upper surface 51 and the lower surface 52. Generally, the annular flange is substantially perpendicular to the central body, although a tapered configuration is likewise contemplated. The inner surface of the outer annular flange includes a pair of tabs 35 which interface with the lower attachment mechanism 47 of the canister. As such, when the tabs interface with the slots of the lower attachment mechanism 47, and the two are rotated relative to each other, a releasable locking configuration is achieved between the two components. The inner surface may also include a plurality of spacing ribs which provide integrity to the outer annular flange and also provide the desired spacing relative to the outer surface 42 of the canister 22. The outer surface 64 of the outer annular flange includes a plurality of grasping members which facilitate the grasping and rotation of the lower cap relative to, for example, the canister.

Figure 6:
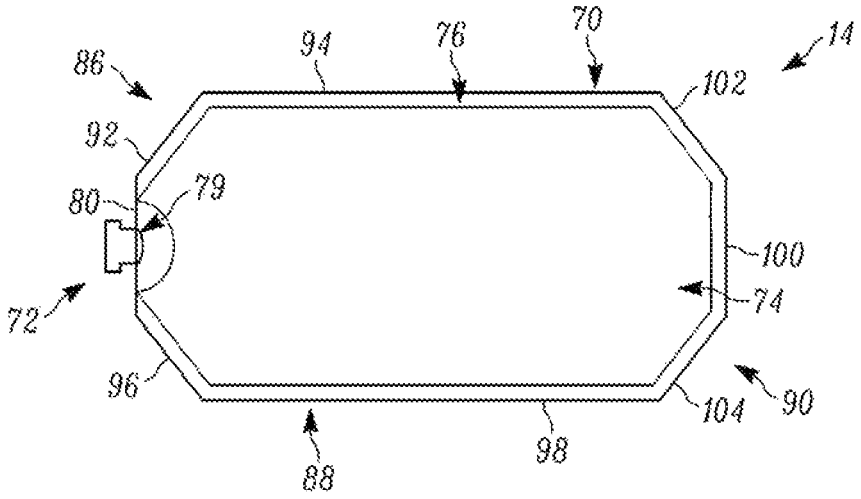
FIG. 6 of the drawings is a top plan view of an exemplary bag assembly for use in association with the dispensing system of the present disclosure.
Figure 6A:
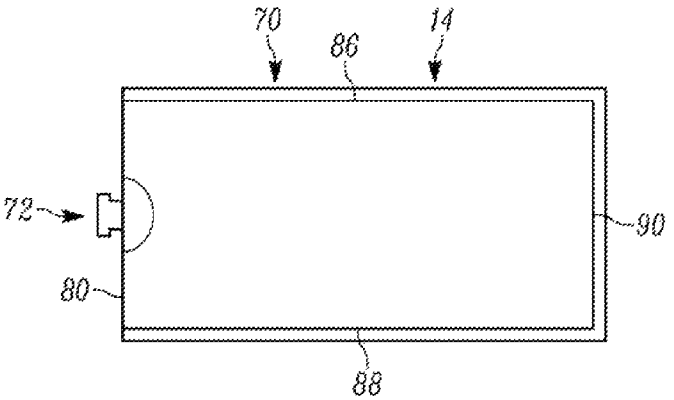
FIGS. 6A through 6D are each a schematic top plan view of alternate embodiments of the bag assembly for use in association with the dispensing system of the present disclosure.
Figure 6B:
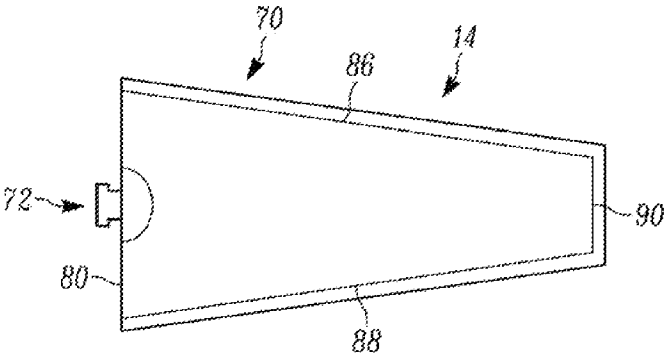

The bag assembly 14 is shown in FIG. 6 as comprising flexible bag 70 and integrated spout and valve member 72. The flexible bag 70 includes film 74 which is bound by seal assembly 76. The film generally comprises a single ply (although not limited thereto) film that is folded over at fold 80 which defines a first end of the flexible bag. The seal assembly 76 includes first side seal 86, second side seal 88 and end seal 90. The first side seal 86 extends between the ends of the flexible bag and includes outer portion 92 which extends outwardly from the integrated spout and valve member 72 at a generally oblique angle, and side portion 94 which generally extends perpendicular or non-perpendicular to the fold 80. It will be understood that the second side seal 88 extends between the ends of the flexible bag in a mirror image of the first side seal 86 on the opposite side of the integrated spout and valve member and includes outer portion 96 and side portion 98. It will be understood that the outer portions 92 and 96 extend outwardly, and, when coupled extend across the top surface of the central body of the lower cap 24 toward the annular flange thereof so that the side portions 94, 98 extend upwardly along the canister. As such, the respective outer portions and the respective side portions generally meet at the interface between the central body of the lower cap and the second end of the canister 22.

The end seal 90 includes central region 100, first side region 102 and second side region 104. The end seal 90 transitions the bag between the first end 40 of the canister 22 and the piston 32. It is contemplated that each of the seals are formed through any number of different techniques, including, but not limited to, heat, RF welding, ultrasonic welding, among others. The film 74 along with the seal assembly 76 provide a fluid tight cavity defined thereby. An opening 79 is disposed across the fold 80, and is configured to be placed in fluid communication with the spout body 106, as will be described below. The configuration of the bag is such that the integrated spout and valve member can be attached to a continuous portion of the film to minimize leaking and the like, with the flexible bag configured to closely match (and to be slightly oversized) relative to the chamber of the canister within which the flexible bag will be positioned. It will be understood that variations to the seals can be made so as to more closely mimic the configuration of the canister 22. It will also be understood that additional dimensional variations may be made to more closely mimic the configuration of the canister 22. The configuration shown, however, provides an easily made pillow type configuration with an integrated and seal free surface upon which the spout is to be coupled, and a shape wherein the spout and the bag are positioned so as to minimize undesirable relative forces which may tend to weaken the connection therebetween.

Figure 6C:
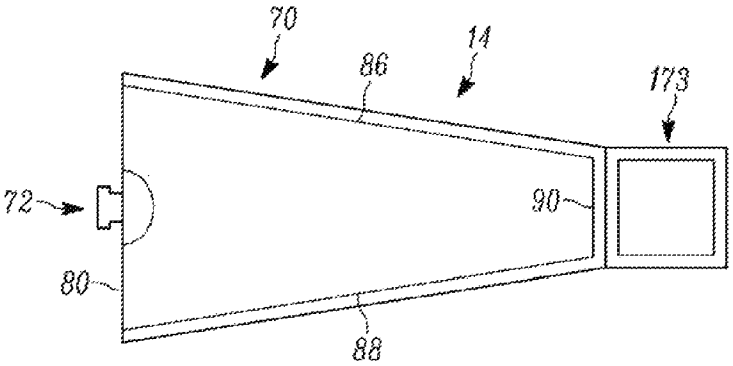
Figure 6D:
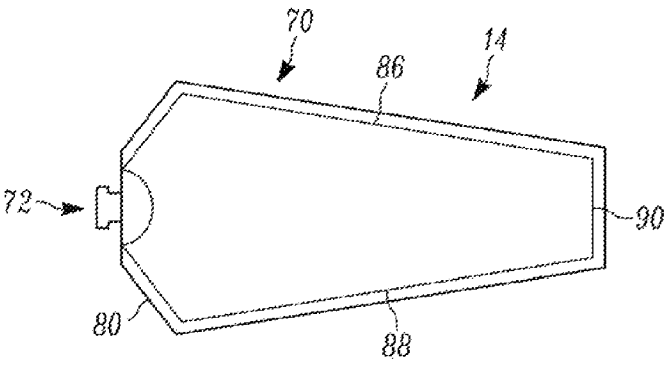
Figure 8:
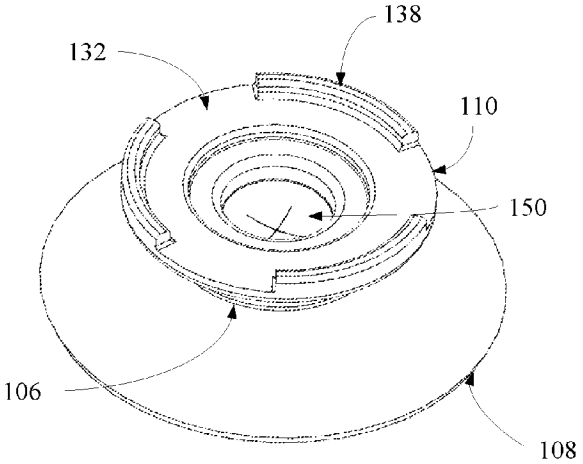
FIG. 8 of the drawings is a bottom perspective view of the integrated spout and valve member of the bag assembly of the dispensing system of the present disclosure.

Additional embodiments of the bag assembly 14 are shown in FIGS. 6A through 6D, and other variations are likewise contemplated. For example, with the embodiment of FIG. 6A, the side seals extend substantially perpendicular to the fold 80 with the end seal 90 being substantially perpendicular to the side seals and substantially parallel to the fold. With the embodiment of FIG. 6B, the side seals taper inwardly from the fold 80 to the end seal 90, narrowing the bag in width generally substantially uniformly (although variations are contemplated). In the embodiment of FIG. 6C, a pull tab 173 is formed from the film of the flexible bag beyond the end seal 90 which provides a member that can be grasped to pull the bag into the canister. Additionally, the side seals taper inwardly from the fold 80 to the end seal 90. It is contemplated that the pull tab 173 may be applied to other embodiments. With the embodiment of FIG. 6D, the side seals comprise a diamond configuration that increases in width from the fold then decreases in width toward the end seal 90. Of course, it is contemplated that variations to the foregoing, or incorporation of various combinations of components is likewise contemplated.

Figure 7:
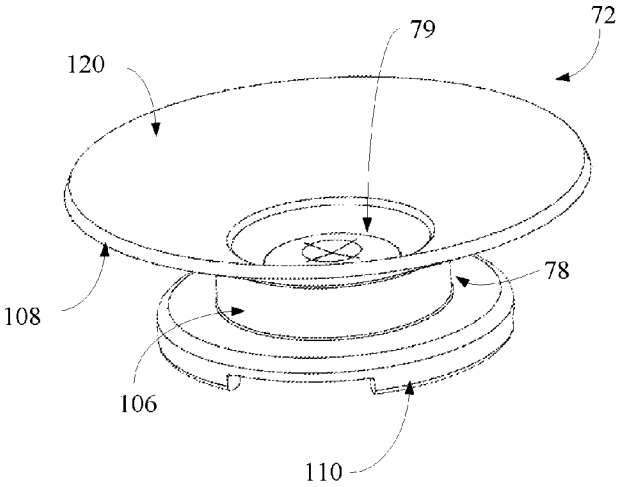
FIG. 7 of the drawings is a top perspective view of the integrated spout and valve member of the bag assembly of the dispensing system of the present disclosure.

The integrated spout and valve member 72 is shown in FIG. 7 as comprising spout portion 78 and valve portion 79. The integrated spout and valve member 72 are integrally molded, and preferably from a single material, such as, for example Polyolefin Elastomers, Polyolefin Plastomers, Olefin Block Copolymers, Thermoplastic Elastomers (TPE), and other lower durometer hardness materials. The preferred durometer hardness is between 30 and 60 Shore A as measured by ASTM D2240. Such a material provides the flexible resilience for bonding to the flexible bag and also for facilitating the formation of the valve.

Figure 10:
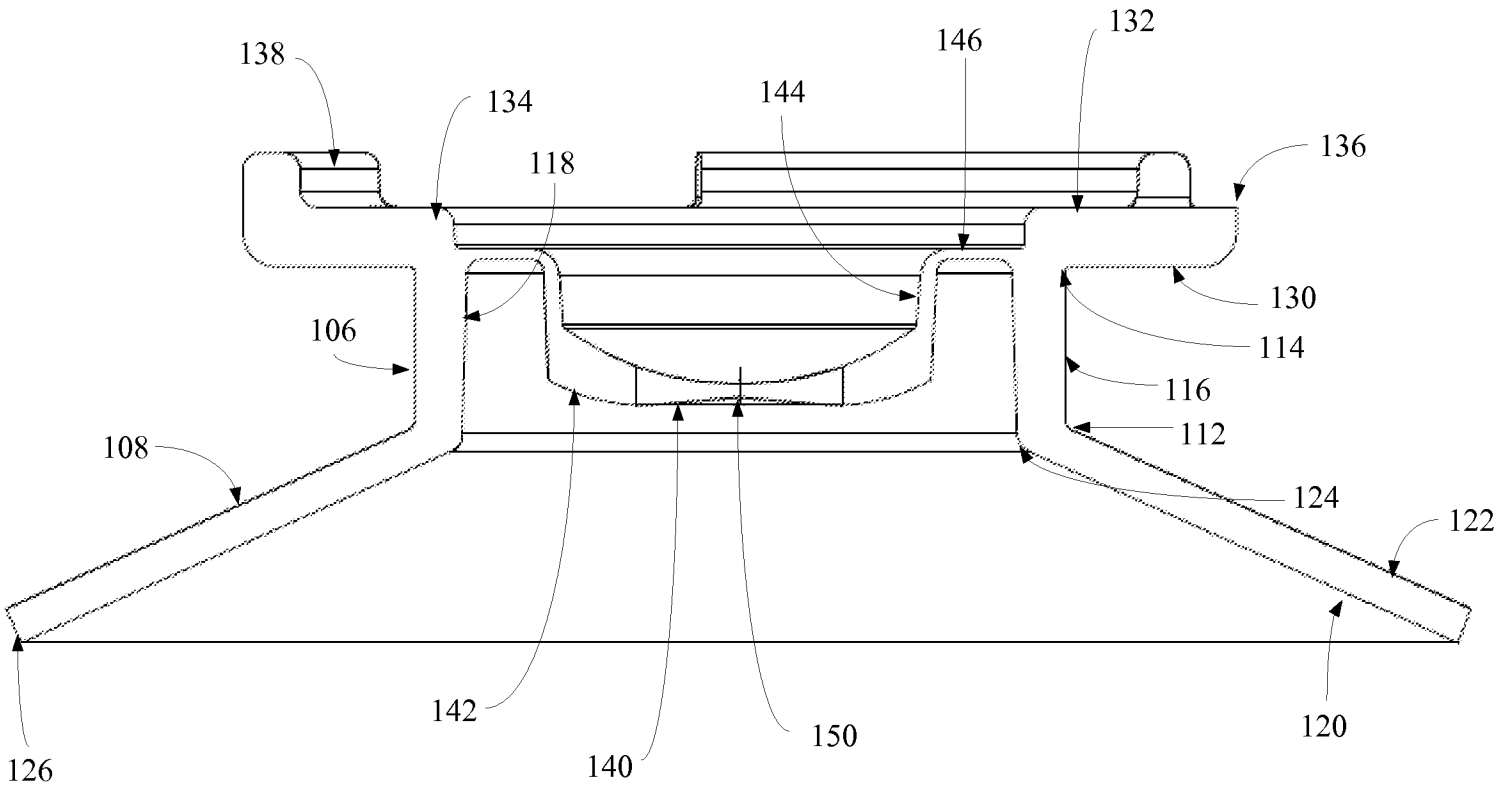
FIG. 10 of the drawings is a cross-sectional view of the integrated spout and valve member of the bag assembly of the dispensing system of the present disclosure.

The spout portion 78 includes spout body 106, annular base flange 108 and outer flange 110. As shown in FIG. 10, the spout body generally comprises a substantially cylindrical member having a proximal end 112, a distal end 114, an outer surface 116 and an inner surface 118. The annular base flange 108 is positioned at the proximal end 112. The outer flange 110 is positioned at the distal end 114 of the cylindrical member. As will be explained below, the outer surface 116 of the spout body is configured to interface with the operating region 55 of the central opening 53 of the lower cap 24.

The annular base flange 108 is shown in FIGS. 7 and 10 as comprising a conical configuration having a concave inner surface 120 and a convex outer surface 122, as well as an inner end 124 and an outer end 126. The inner end meets the proximal end 112 of the spout body 106, and the outer end extends outwardly therefrom. The conical configuration of the annular base flange and the dimensions of the annular base flange substantially correspond to the conical portion of the central body 50 of the lower cap 24 about the operating region 55. In the embodiment shown, the annular base flange, and in particular, the outer surface 122 thereof is coupled to the inner surface of the film 74 about the opening 79 so that the spout body 106 overlies the opening 79 and provides fluid communication with the inner cavity of the flexible bag. Of course, in other embodiments, the spout can be coupled to the outside of the flexible bag. However, in the configuration shown, the bag overlies the inner conical portion of the lower cap, which minimizes the chance of destroying the coupling therebetween.

The outer flange 110 is positioned at the distal end 114 of the spout body 106. The outer flange 110 includes inner surface 130, outer surface 132. The inner end 134 meets the distal end 114 of the spout body. The outer end is spaced therefrom. The outer flange is generally of a diameter that is smaller than that of the annular base flange, and the slot region 54 of the lower cap is configured to permit the passage of the outer flange therethrough so as to direct the spout into the desired orientation within the operating region. The outer flange has a plurality of outer lip portions 138. As will be explained, the outer lip portions 138 cooperatively provide an annular flange which creates a cavity defined by the lip portions and the outer surface 132 of the flange. A tamper evident cover or other sterilization cover can be positioned within the cavity, with the lip portions protecting the cover from outside inadvertent contact, precluding potential inadvertent damage. The lip portions are generally separated so as to facilitate access to the cover to aid in the removal thereof. In other embodiments, the annular lip portion may comprise a single portion without any breaks therebetween, or a single break (i.e., the single lip portion extends substantially entirely about the outer end 136 of the outer flange 110).

Figure 9:
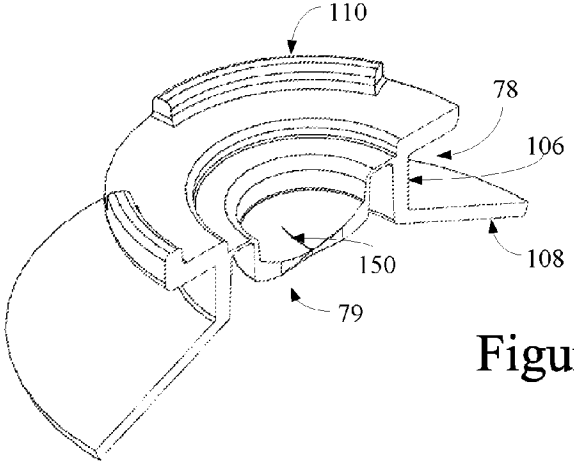
FIG. 9 of the drawings is a perspective cross-sectional view of the integrated spout and valve member of the bag assembly of the dispensing system of the present disclosure.

The valve portion 79 is shown in FIG. 9 as comprising central portion 140, annular marginal portion 142, annular sidewall portion 144 and annular outwardly extending portion 146 as shown in FIG. 10. The central portion 140 includes a plurality of slits 150 which function as a valve opening. As will be explained below, selectively (i.e., when the central portion 150 is deformed) the valve opening allows flowable material to pass therethrough. The central portion increases in thickness from the inner end thereof (i.e., the center thereof) to the outer edge thereof where the central region meets the annular marginal portion. The annular marginal portion extends about the central portion and terminates at a marginal edge. The annular marginal portion likewise increases in thickness from the central region to the marginal edge. In the embodiment shown, the inner and outer surfaces of the annular marginal portion track and correspond to each other, whereas the opposing surfaces of the central region come closer together toward the center thereof, such that the center is the thinnest region, preferably, of the central opening and the annular marginal portion.

The annular sidewall portion 144 extends from the marginal edge toward the distal end of the spout body, and generally spaced apart from the inner surface of the spout body. It will be understood that in the embodiment shown, the annular sidewall portion is slightly frustoconical in that the diameter increases slightly toward the distal end of the spout body. The annular outwardly extending portion 146 joins the annular sidewall portion 144 to the inner surface of the spout body. The annular outwardly extending portion meets the inner surface of the spout body spaced apart from the distal end of the spout body, with the central portion 140 likewise being spaced apart from the proximal end of the spout body such that the entirety of the valve (in the resting closed orientation shown) remains within the confines of the spout body. In the embodiment shown, the spout body thickness is larger between the proximal end thereof and where the annular outwardly extending portion meets the inner surface of the spout body, than the thickness between the annular outwardly extending portion and the distal end of the spout body. Such a configuration aids in the outward movement of the annular outwardly extending portion 146 and inward return movement when the valve cycles between an closed and open position. In the embodiment shown, the annular outwardly extending portion is substantially planar and perpendicular to the inner surface of the spout body, and to the flow through the valve. Of course, in other embodiments, the annular outwardly extending portion 146 could be non-perpendicular to the inner surface of the spout body. It will be understood that the entirety of the integrated spout and valve member are formed as an integrated monolithic component that is molded as a single member, with the valve structure incorporated therein.

The operation of the valve is such that when the pressure increases on the inside of the valve, eventually, the annular outwardly extending portion rotates outwardly, with the annular sidewall portion rolling upon itself. Eventually, the annular marginal portion and the central portion undergo deformation such that the openings 150 are urged into the open position, allowing the passage of flowable material therefrom. The flow continues, until the pressure within the flexible bag is such that there is no longer enough force to cause the valve to deform, to, in turn, open the openings 150 of the central portion. In such a configuration, the resilience of the valve returns the valve to the original configuration (much like the configuration shown in the drawings), thereby closing the valve and precluding passage of additional flowable material. The particular pressure at which the valve opens and closes is determined through the material, as well as the dimensions of the different components. Another example of the operation of such a deformable a valve and its openings is shown in U.S. Pat. Nos. 5,439,143; 5,339,995; 5,213,236 all issued to Brown et al. All of the foregoing patents are incorporated in their entirety herein by reference.

Figure 12:
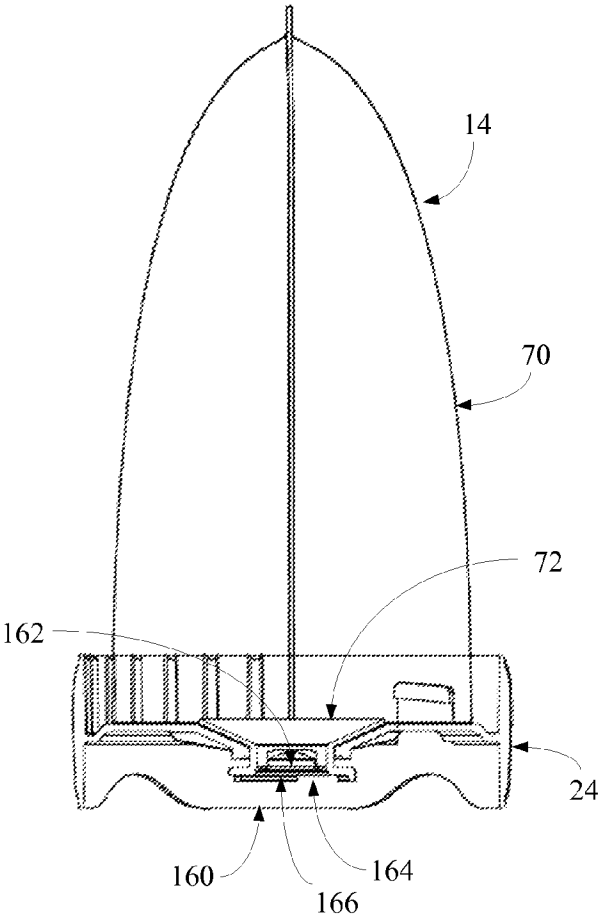
FIG. 12 of the drawings is a cross-sectional view of a bag assembly positioned within the canister and coupled to the lower cap of the dispensing system.
Figure 11:
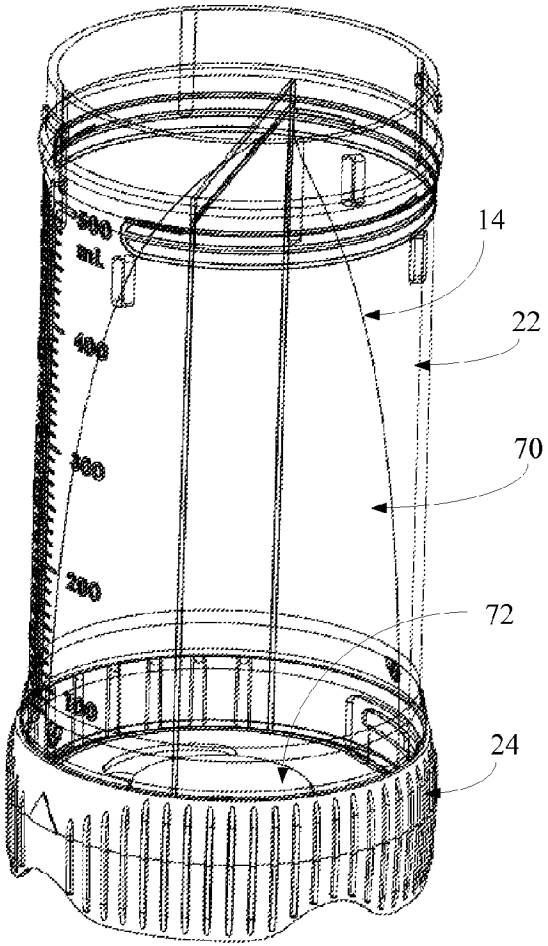
FIG. 11 of the drawings is a perspective view of a bag assembly positioned within the canister and coupled to the lower cap of the dispensing system.

As shown in FIG. 12, the cover 160 may be positioned over the outer surface of the 132 of the outer flange 110 in the cavity defined thereby in cooperation with the outer lip portion 138. The cover includes an inner surface 162, a portion of which is adhered or otherwise releasably bonded to the outer surface of the outer flange, an outer surface 164 and a pull tab 166 which aids in the removal of the same. The cover may comprise a number of paperboard, polymer, metal materials. A multi-layer material having a metal foil or a metallized material is contemplated. Of course, the cover is not limited to any particular material.

To assemble a dispensing system, the user is first provided with a bag assembly 14. Typically, the bag assembly 14 is prefilled with a desired flowable material (such as a sauce, a dressing, a marinate, a vinegar, an oil, among others). Generally the bag is filled with a predetermined quantity of the flowable material, with, preferably some head space within the bag assembly (as the bag assembly is preferably dimensionally larger than the canister).

Once provided, the bag is coupled to the lower cap 24. To achieve the same, the user directs the integrated spout and valve 72 into operative position within the central opening. In more detail, the outer flange of the spout is pushed through the slot region 54 of the lower cap so that the spout body can be captured within the operating region 55 of the central opening. Once in the proper position, the annular base flange 108 is in abutting engagement with the conical portion of the central body. It may be necessary to elastically deform the outer flange to achieve insertion through the slot region of the central opening.

Once the bag assembly is coupled to the lower cap, the bag assembly is inserted into the canister 22 and the lower cap 24 is coupled to the canister. In particular, the user slides the bag assembly through the second end 41 of the canister. Due to the amount of filling, the user should be able to slidably insert the flexible bag without substantial difficulty. As the bag assembly reaches full insertion, or at least insertion sufficient to engage the lower cap and the canister without pinching a portion of the bag therebetween, the tabs 35 of the outer annular flange 50 are directed into contact with and engagement with the lower attachment mechanism 47 and the slots thereof. Once engaged, the two are turned relative to each other to lockingly engage the two components. Advantageously, while it is contemplated that a threaded engagement requiring more than a quarter of a turn is contemplated, the tab and slot engagement allows for a minimal relative rotation of the canister and the lower cap relative to each other (and in turn, a minimum of rotation of the bag assembly within the canister). It has been found that limiting the relative rotation limits the possibility of damage to the underlying bag assembly.

The user then couples the dispensing mechanism 20 to the canister 22. It will be understood that the dispensing mechanism can be coupled to the canister prior to insertion of the bag assembly into the canister and attachment of the lower cap. To achieve the attachment, the user positions the piston 32 within the canister through the first end thereof. The rod is coupled thereto and to the rod moving assembly 36. Next, the body 26 of the dispensing mechanism can be coupled to the first end of the canister by interfacing the mounting mechanism 30 with the upper attachment mechanism 45. Once fully inserted, the piston 32 is positioned proximate to the second end of the flexible bag (i.e., opposite the integrated spout and valve member). The system is now ready to dispense flowable material from within the bag assembly.

To dispense flowable material, the user actuates the rod moving mechanism to direct the piston 32 toward the second end of the canister and the lower cap. For example, the rod moving mechanism can advance the piston a predetermined distance along the canister each time the mechanism is actuated. In other embodiments, the system may be indexed, or may depend on the amount of force exerted on the rod moving mechanism.

Regardless of the manner in which the piston movement is achieved, as the piston is directed toward the second end of the canister, the piston imparts force against the flexible bag and eventually applies pressure against the flowable material within the flexible bag. As the pressure within the bag increases, eventually, a predetermined pressure/force is observed at the valve that is required to open the valve. When such pressure is reached, the valve opens and directs flowable material through the opening of the valve. The flow continues until the force required to maintain the valve in the open position is no longer present. At such time, the resilience of the valve returns the valve to a closed orientation. This cycle can be repeated as desired until the piston has reached the end of its travel, and/or the flexible bag no longer contains flowable material which the piston can apply enough pressure to open the valve.

Once the user has completed dispensing, the user can uncouple the lower cap from the canister. Next, the bag assembly can be decoupled from the lower cap and the bag assembly can be discarded. A new bag assembly can be provided and coupled to the dispenser as set forth above. That is, there is no need to clean the inside of the canister, as the inside of the canister is isolated from the flowable material and is not contaminated by the flowable material. Advantageously, contamination is minimized as well as spoilage and other negative results of the inadvertent failure to properly clean the components where there is direct contact with flowable material.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A dispensing system comprising:

a dispenser housing assembly having:

a canister with a first end and a second end;

a dispensing mechanism coupled to the canister at the first end thereof, the dispensing mechanism having a piston slidably movable along the canister between the first end and the second end thereof; and a lower cap coupled to the canister at the second end thereof, the lower cap including an upper surface, a lower surface a central body with a central opening extending therethrough, the central opening having an operating region that is centrally disposed on the lower cap, and a slot region adjacent thereto; and a bag assembly having:

a flexible bag defined by a plurality of seals forming the sides and second end, with the first end defined by a fold, the flexible bag defining a fluid tight cavity with an opening at the fold for providing ingress into the fluid tight cavity;

an integrated spout and valve member molded as a single member from a single material coupled to the flexible bag at the first end and extending over the fold, the integrated spout and valve member being placed in fluid communication with the fluid tight cavity by way of the opening, the integrated spout and valve member further including:

a spout portion including a spout body with a proximal end and a distal end, an annular base flange coupled to the spout body at the proximal end and extending outwardly therefrom, with an outer flange positioned proximate the distal end of the spout body opposite the annular base flange, the outer flange extending outwardly from the spout body; and a valve portion disposed within the spout body, the valve portion including a central portion with an opening, an annular marginal portion extending therearound, an annular sidewall portion extending from the annular marginal portion toward the distal end of the spout body, and an annular outwardly extending portion extending outwardly from the annular sidewall portion and coupled to an inner surface of the spout body, the valve portion spanning across the spout body, with the opening providing passage therethrough, wherein, the outer flange is extendible through the central opening, whereupon, the spout body is directable into the operating region so that the annular base flange overlies the upper surface of the lower cap and the outer flange overlies the lower surface of the lower cap.

2. The dispensing system of claim 1 wherein the valve portion is maintained between the proximal end and the distal end of the spout body.

3. The dispensing system of claim 2 wherein the spout body has an inner surface defining a diameter, the inner surface between the proximal end and the valve portion having a first diameter which is smaller than a second diameter of the inner surface between the distal end and the valve portion.

4. The dispensing system of claim 3 wherein the annular base flange has an outer surface which is sealed to an inner surface of the flexible bag such that a portion of the annular base flange is positioned within the fluid tight cavity of the flexible bag, and a portion of the flexible bag overlying the annular base flange is sandwiched between the annular base flange and the upper surface of the lower cap.

5. The dispensing system of claim 4 wherein the annular base flange comprises a conical configuration extending outwardly from the proximal end of the spout body in a concave upward configuration.

6. The dispensing system of claim 5 wherein the central body of the lower cap further includes an inner conical portion disposed about the central opening, the inner conical portion substantially corresponding to the conical configuration of the annular base flange.

7. The dispensing system of claim 1 wherein the canister and the lower cap are coupled together through rotative engagement of less than a half turn of the lower cap relative to the canister.

8. The dispensing system of claim 1 wherein the outer flange further includes an inner surface and an outer surface, the outer flange having a diameter smaller than that of the annular base flange.

9. The dispensing system of claim 8 wherein the outer flange is substantially perpendicular to the spout body.

10. The dispensing system of claim 8 wherein an outer lip portion is disposed on the outer surface of the outer flange, to, in turn, define a cavity together with the outer surface.

11. The dispensing system of claim 10 wherein a removable cover is positioned within the cavity so as to extend across the distal end of the spout body and to cover the valve portion.

12. The dispensing system of claim 1 wherein the flexible bag further comprises a pull tab positioned proximate the second end of the flexible bag, the pull tab structurally configured to facilitate the grasping thereof so as to pull the flexible bag through the canister and into a desired orientation.

13. The dispensing system of claim 12 wherein the pull tab is integrally formed with the flexible bag.

* * * * *